United States Patent [19]

Schofield

[11] Patent Number: 4,706,551

[45] Date of Patent: Nov. 17, 1987

[54] ENCLOSURE

[76] Inventor: Paul S. Schofield, Lion Works, Low Whitehouse Row, Leeds 10, West Yorkshire, United Kingdom

[21] Appl. No.: 777,592

[22] Filed: Sep. 19, 1985

[30] Foreign Application Priority Data

Sep. 20, 1984 [GB] United Kingdom ..... 8423820
Feb. 14, 1985 [GB] United Kingdom ..... 8503833

[51] Int. Cl.[4] ..... F24F 7/007

[52] U.S. Cl. ..... 98/1; 98/33.1; 98/115.3; 135/93; 135/105; 135/106

[58] Field of Search ..... 98/1, 29, 33.1, 42.02, 98/115.3; 135/93, 95, 97, 105, 106, 900, 902

[56] References Cited

U.S. PATENT DOCUMENTS

| | | | |
|---|---|---|---|
| 1,315,497 | 9/1919 | Higdon et al. | 135/902 X |
| 1,884,449 | 10/1932 | Wickstrum | 135/106 |
| 2,010,472 | 8/1935 | Angel | 135/902 X |
| 2,612,900 | 10/1952 | Treppa | 135/902 X |
| 2,943,634 | 7/1960 | Morgan | 135/106 X |
| 3,051,163 | 8/1962 | Trexler | 135/106 X |
| 3,055,379 | 9/1962 | Fink | 135/93 X |
| 3,119,358 | 1/1964 | Colson et al. | 135/93 X |
| 3,766,844 | 10/1973 | Donnelly et al. | 135/93 X |
| 3,925,828 | 12/1975 | Kim | 135/902 X |
| 4,581,986 | 4/1986 | Conklin et al. | 98/33.1 X |

FOREIGN PATENT DOCUMENTS

| | | | |
|---|---|---|---|
| 1145807 | 10/1957 | France | 135/106 |
| 2073280 | 10/1981 | United Kingdom | 135/93 |

OTHER PUBLICATIONS

J. C. Penney Advertisement, *The Washington Post* Newspaper, Nov. 2, 1977.

*Primary Examiner*—Harold Joyce
*Attorney, Agent, or Firm*—Henry Sternberg; Bert J. Lewen

[57] ABSTRACT

A controlled access enclosure comprises an external frame (1) within which is suspended a cover (15). Access is gained to and from the unit by means of a zipped opening (20) in one part of the enclosure and a flap door arrangement in another part of the enclosure, the flap door being surrounded by a flange (21) which may be sealed to a hazardous working area to prevent contamination escaping from the working area into the surrounding clean environment.

10 Claims, 13 Drawing Figures

ENCLOSURE

The present invention relates to an enclosure for use by a person who is or has been handling dangerous or toxic materials, an example being asbestos.

Due to the previously widespread use of asbestos in the building industry, it is now required for health and safety reasons to remove asbestos from buildings in which it has been used. This process is referred to as "asbestos stripping" and the process itself poses a serious health hazard. As the asbestos is stripped, asbestos dust may escape into the environment and also contaminate the clothing of the person stripping the asbestos. Thus it is desirable to provide a means of protecting the environment from asbestos dust when stripping is taking place, and also of allowing the person to decontaminate himself and his clothing before leaving the working area and entering the environment.

According to the present invention there is provided an enclosure comprising an external frame, a flexible cover suspended from and so as to hang within the frame, said cover including a first opening through which an operative may pass between the enclosure and a surrounding clean environment, and a second opening having the capability of being sealed to a hazardous working environment, the enclosure being such that the hazardous environment is completely sealed off from the clean environment whilst allowing controlled access between the clean and hazardous environments.

By hazardous environment is meant any environment within which dangerous materials are being handled, and may comprise an entrance to a larger, hazardous working area or alternatively a piece of dangerous material itself, for instance an asbestos ceiling panel.

Preferably the external frame is able to be disassembled into a number of easily transportable component parts so that the enclosure may be transported to a working site and quickly and easily erected there.

Preferably, the external frame includes at least four upright members connected together at their lower ends by at least four horizontal base members and at their upper ends by at least two horizontal upper members.

The enclosure may comprise a single compartment, or alternatively it may have a plurality of interconnected compartments with each compartment having a flexible partitioning wall in common with the or an adjacent compartment, the or each partitioning wall or a part thereof being openable to allow an operative to move between compartments.

In either case, the enclosure may be adapted so as to accommodate moving air which enters through a vent in the wall having the first opening and is pumped out of the opposite end of the enclosure. Thus, excess contamination which may build up inside the enclosure may be safely removed.

Also, in either case, the enclosure may include a sealed-in floor of flexible material which is made continuous with the side and end walls and lies completely within the frame.

The flexible material may be plastics sheeting which may be, for instance, fibre reinforced for extra strength, and may also be flame retardant.

Thus, a particular advantage of the present invention is that the flexible cover may be easily washed down using mild detergent, since any contamination will be restricted to the interior walls of the enclosure which lie entirely within the frame. Furthermore, the flexible cover may be easily detached from the frame and folded to form a compact bundle. The frame may then be disassembled into its component parts and the whole enclosure easily transported from one site to another.

Preferably, the cover is suspended by means of a plurality of straps and buckles extending around the enclosure, the straps being connected to the cover in such a manner as to allow the straps to be wrapped around said horizontal upper members to suspend the cover therefrom.

Preferably, the cover includes at its lower end a plurality of sealing flaps extending beyond the confines of the enclosure and passing underneath the horizontal base members to form a seal with the floor.

The enclosure may also include pipe inlets and outlets for water, air movers, vacuum cleaners and the like. The pipe inlets and outlets may also include valves.

Embodiments of the present invention will now be described by way of example only, with reference to the accompanying drawings in which.

Figure 1:
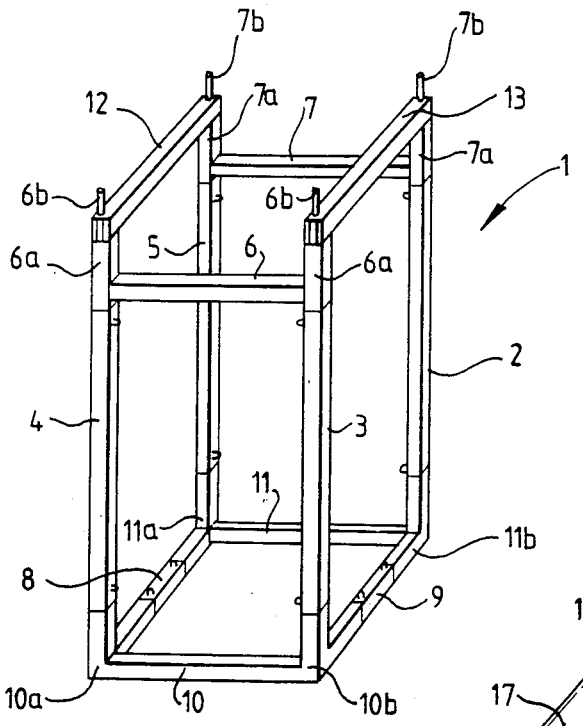
FIG. 1 is a perspective view of the external frame of a first embodiment of the present invention, without the cover attached.

Referring to FIG. 1 an enclosure 1 comprising a single compartment is composed of an external frame. The frame is erected by assembling a number of component parts, these parts comprising four identical uprights 2, 3, 4 and 5, these uprights being connected between upper side cross members 6, 7 and lower end and side cross members 8, 9 and 10, 11 respectively.

Across the top of the frame are slid two upper end cross members 12, 13, these having holes at each end so that they may be slid down over tubular projections **6*b*, 7*b* extending from the uprights 2, 3, 4 and 5**.

The frame components are constructed in the following manner; the upper side cross members 6, 7 are each welded to short upright sections **6*a*, 7*a* respectively at each end, and the upper ends of the short upright sections 6*a*, 7*a***have entending upwardly from them short tubular sections *6b*, *7b*. The lower side cross members 10, 11 are each welded to corner sections 10*a*, 10*b*, 11*a*, 11*b*, at each end thereof. The uprights 2, 3, 4 and 5 are straight lengths of framework connecting between the upper and lower members. Similarly, straight lengths 8 and 9 are connected between the lower side cross members 10, 11 to form a base. The connections are of a simple, snap fit type, details of which will be described later.

The frame members are constructed from hollow square sections of steel or aluminum, and may be easily disassembled in order to be transported.

Figure 2:
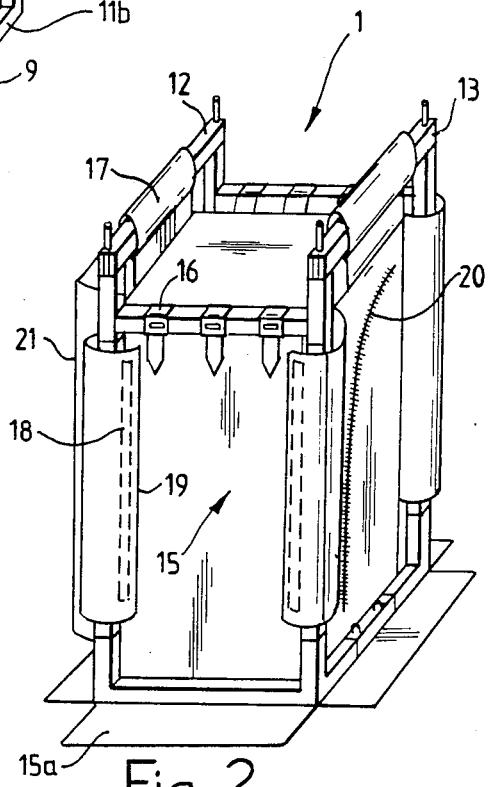
FIG. 2 is a perspective view of the frame shown in FIG. 1 with the cover attached.

Referring now to FIG. 2, a flexible cover 15 is suspended within the frame 1 by straps and buckles 16 and loops 17 of material wrapped around the upper end cross members 12, 13. Each corner of the cover is secured to an upright by means of "velcro" strips 18 and flaps 19. One end of the enclosure has a first opening consisting of a zipped door 20 and the opposite end has a second opening including a flange 21 which may be sealed to a working area. Floor sealing flaps 15*a* extend around the bottom edges of the cover 15*a* and pass underneath the framework to form a seal with the floor.

This particular embodiment of the invention is used for an operative to actually work inside. The flange 21 is sealed to the working area and the operative steps into the enclosure through the zip door 20. The compactness and ease of assembly makes this type of enclosure ideal for small repetitive jobs such as removing small asbestos panels from cupboards in a block of flats.

With reference to FIGS. 3, 4, 5 and 6, a second embodiment of the present invention comprises the same basic frame structure shown in FIG. 1, but extended to form a rectangular structure by the addition of longer lower side cross members 25, additional upper side cross members 26, additional upper cross members 27 and uprights 28.

It should be appreciated that any number of compartments may be constructed in this manner.

Figure 3:
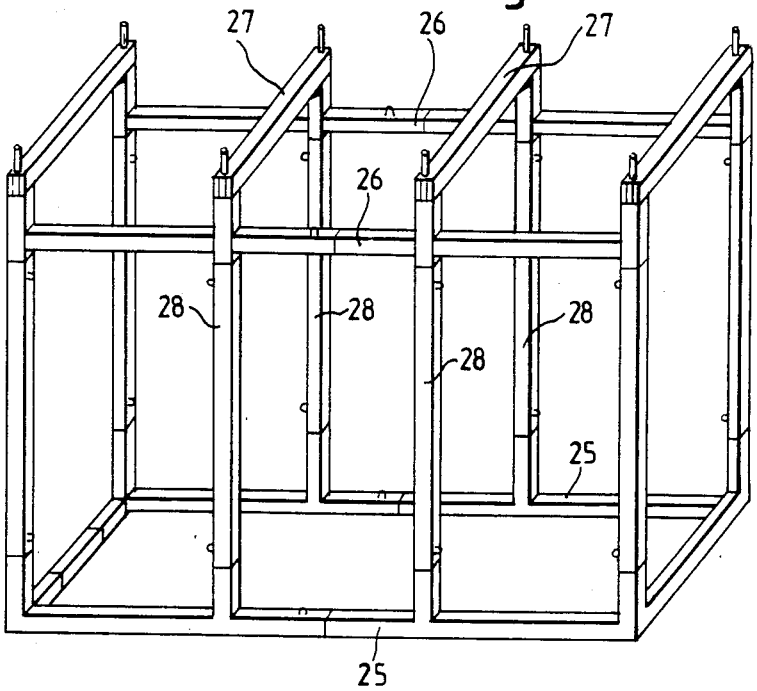
FIG. 3 is a perspective view of the external frame of a second embodiment of the present invention, without the cover attached.

A flexible cover 30 similar to that shown in FIG. 1 is again suspended within the frame shown in FIG. 3 by means of a number of straps and buckles 31 and loops of material 32 wrapped around transverse cross members 27.

At end A of the enclosure there is attached around opening 43 a flange 42 for sealing to a working area.

At the other end B there is provided a zip door 48 having a mesh vent 48*a* to allow air to flow from the clean environment end B to the working environment end A when the zip door is closed. Floor sealing flaps 30*a* extend around the bottom edges of the cover 30, as in the previous embodiment.

Figure 5:
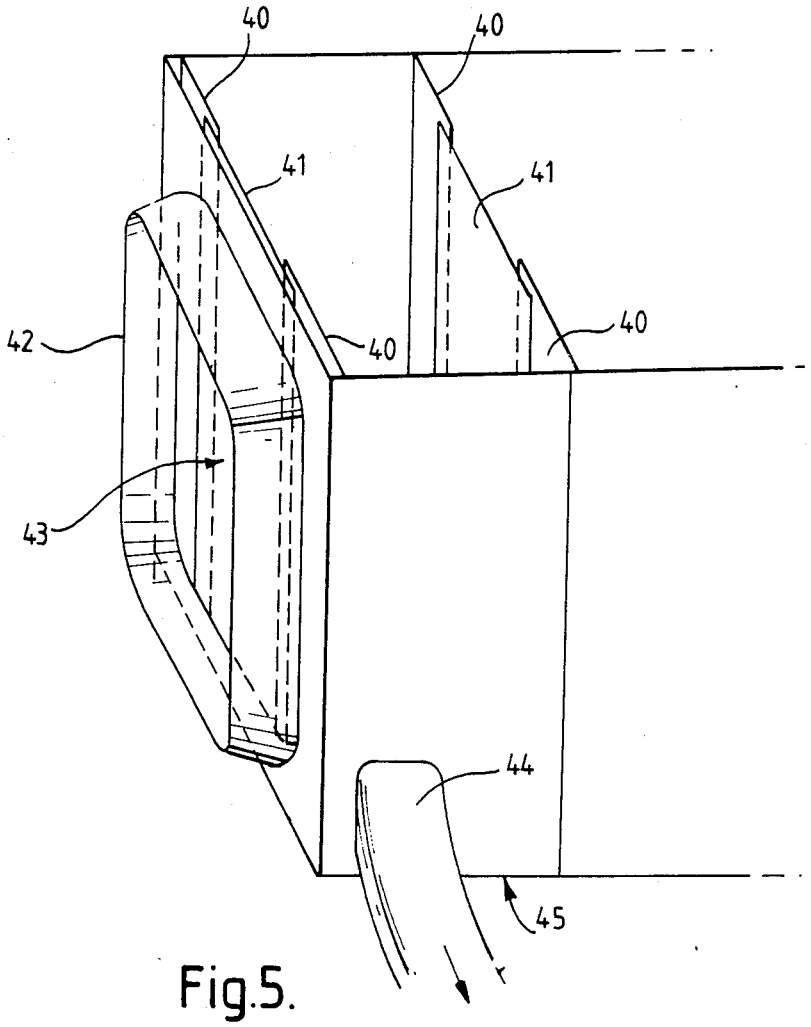
FIG. 5 is a perspective view of the cover of the second embodiment of the present invention, showing details of the interconnecting compartments.
Figure 6:
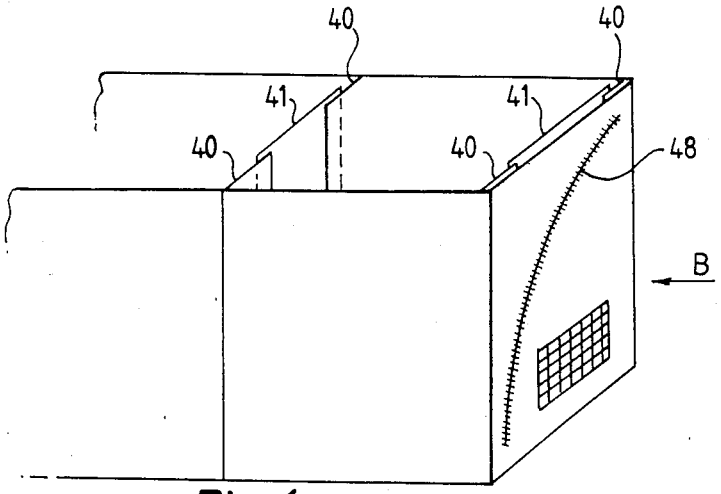
FIG. 6 is a perspective view of the opposite end of the enclosure shown in FIG. 5.

Referring to FIGS. 5 and 6 each interconnecting and end wall of the enclosure comprises sealing flaps 40 extending from the side walls of the enclosure towards the centre and spanning the distance from the top of the enclosure to the base, and a central door strip 41 spanning the distance from the top of the enclosure to the base and having a width sufficient to overlap each sealing flap 40 along all of its length, the sealing flaps 40 and door strips 41 being attached to the top of the enclosure at their upper ends. This arrangement allows clean air to be sucked through the enclosure, from the end B to the end A, in which case the door strips 41 move away from their associated sealing flaps in the direction B to A, thus allowing continuous air flow, and should the movement of air cease, due to a pump breakdown for instance, the door strips 41 fall back towards their associated sealing flaps 40 to form a seal against leakage of contamination from the enclosure.

Figure 7:
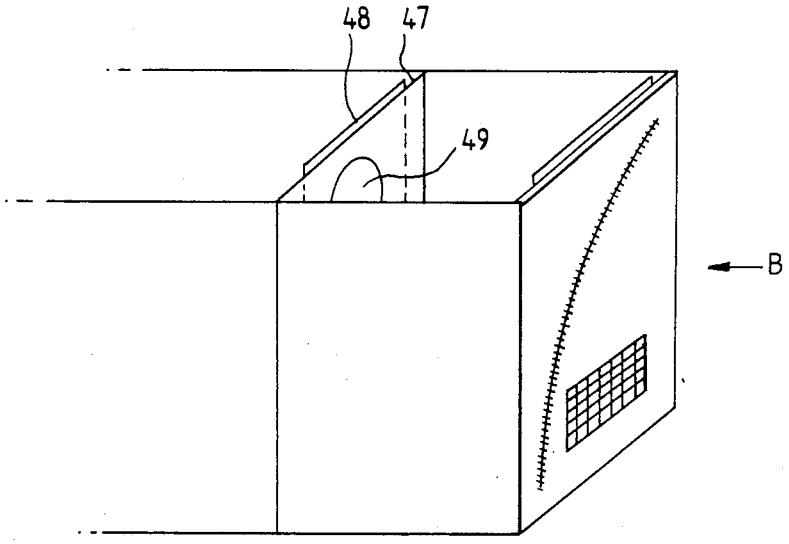
FIG. 7 is a perspective view of the cover of the second embodiment of the present invention, showing an alternative arrangement of interconnecting walls.

FIG. 7 shows an alternative arrangement of interconnecting and end walls, in which there is provided a single piece of flexible material 47 having an oval shaped aperture contained therein and being attached to the side, top and base of the enclosure. A door strip 48 is attached at its upper end to the top of the enclosure, and operates in a similar manner to the arrangement shown in FIG. 6.

The flexible cover may be of any plastics material and may be fibre reinforced. One example of a suitable material is 600 g PVC coated polyester, which is translucent, flame retardant and has a cold crack temperature no higher than −16° C.

Figure 8:
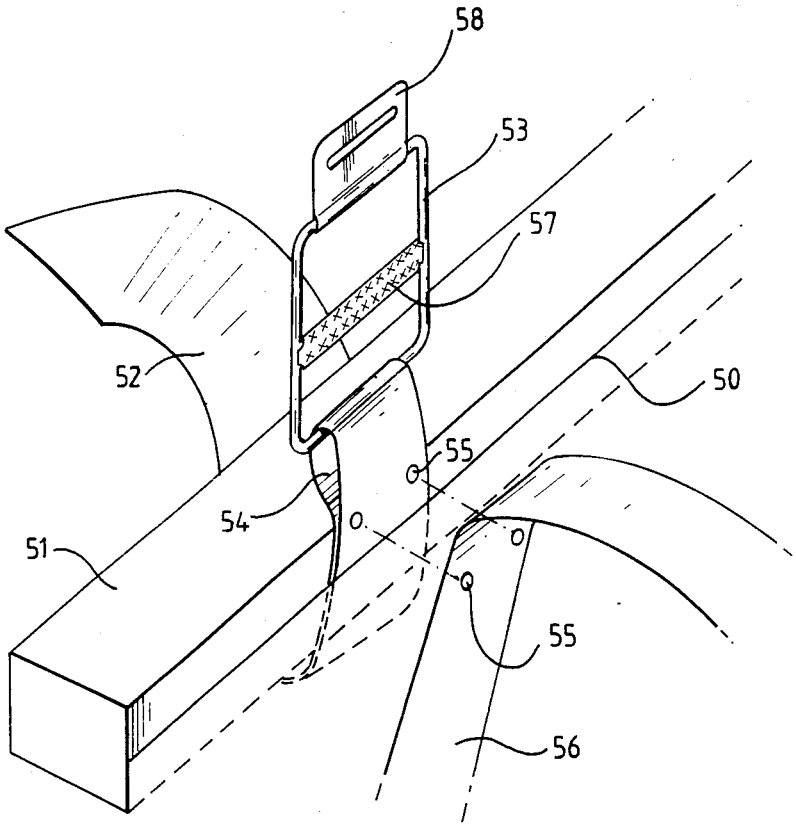
FIG. 8 is a perspective view of the enclosure showing details of the fasteners used to suspend the cover within the frame.

A sealed in floor 45 which lies completely within the frame may also be provided. Referring to FIG. 8, the cover 50 is attached to the external frame 51 at the top of the enclosure by means of a strap 52 and buckle 53. The strap 52, which has a loop 54 at one end is attached to the outside of the cover 50 and secured there by rivets 55. At the same point, on the inside of the cover a reinforcing strip 56 is attached. The loop 54 encloses the buckle 53 which has a grip bar 57 and top flange 58. The cover is attahced to the frame member 51 by passing the strap 52 underneath the frame member 51, around the grip bar 57, back through the buckle 53. On pulling down of the strap 52, the grip bar 57 slides down the buckle 53 to grip the strap 52 and hold the cover in place. The flange 58 is for attaching webbing to pull to release the strap from the buckle when the enclosure is required to be disassembled.

Figure 4:
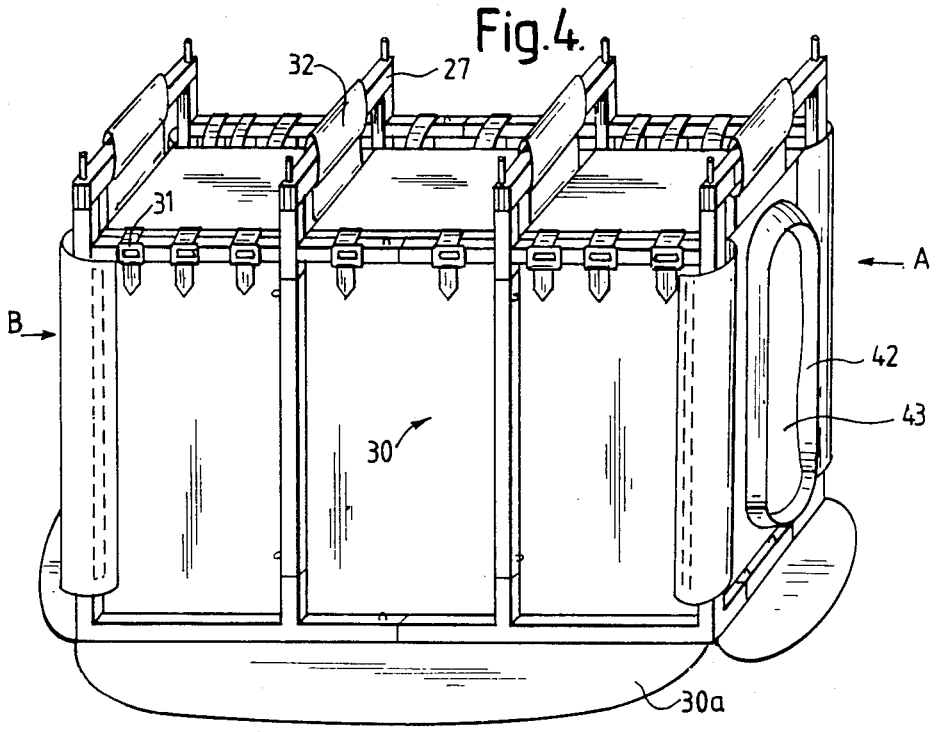
FIG. 4 is a perspective view of the frame shown in FIG. 3, with the cover attached.

In use, an operative, having finished working in the hazardous environment to which the enclosure of FIG. 4 is attached by the flange, enters the enclosure through the opening 43. He then removes his contaminated clothing and moves through the interconnecting wall to the central compartment where there may be provided a water supply to wash down with. He then enters the third compartment and puts on clean clothing kept there, and finally emerges from the zipped door 48 into the clean environment. Of course, this procedure can be equally followed in reverse.

Figure 9:
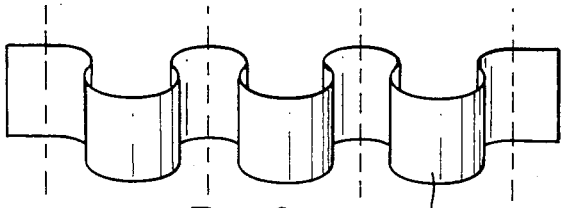
FIG. 9 is a perspective view of pockets attached to the inside of the cover.

Referring to FIG. 9, in the compartment closest to end B there may be attached to the inside of the cover, near the floor, slots or pockets 60 for holding transit footwear.

Figure 10:
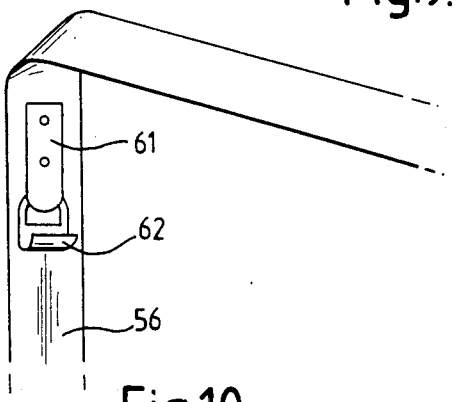
FIG. 10 is a perspective view of a clothes hook attached to the inside of the cover.

Referring to FIG. 10, the reinforcing strips 56 may hold a number of hooks 62 for protective clothing to be hung on. The hooks 62 are attached to the strip 56 by a piece of webbing 61.

Figure 11:
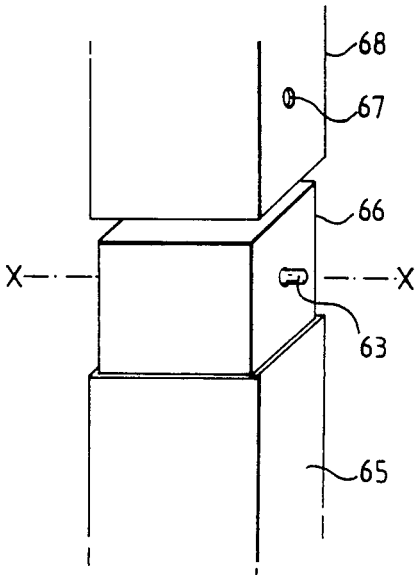
FIG. 11 is a detailed view of the connecting mechanism of the external frame.
Figure 12:
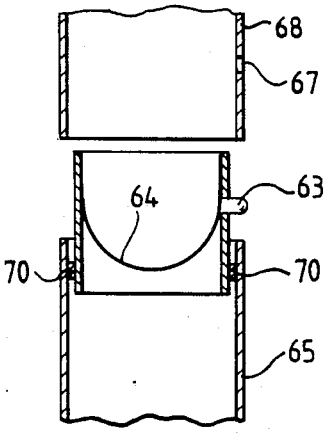
FIG. 12 is a longitudinal section through the line X—X of FIG. 11.

Referring now to FIGS. 11 and 12, the means to connect the various frame components together comprises a main frame member 65 which is hollow and has a square cross section. Inside the member 65 is secured by fixtures 70 a connecting member 66 which is also hollow and of square cross section, but has a smaller cross section than the member 65 so that the connecting member 66 fits snugly within the member 65 with its upper end protruding from the upper end of the frame member 65. There is a hole drilled in one side of the upper end of the connecting member 66 which accommodates a peg 63. The inner end of the peg 63 engages against one end of a C-shaped piece of sprung metal 64, inside the connecting member 66, the other end of which is fixed to the opposite side of the connecting member 66. The arrangement is such that when an upper frame member 68, also of square cross section and having a hole 67 drilled in one of its faces is slid over the protruding member 66, the peg 63 will be pushed into the member 66 and will subsequently spring back to engage the upper frame member 68 by passing through hole 67. The two frame members 65 and 68 can be disconnected by pushing on peg 63 and sliding the upper member 68 over the outside of the connecting member 66.

Figure 13:
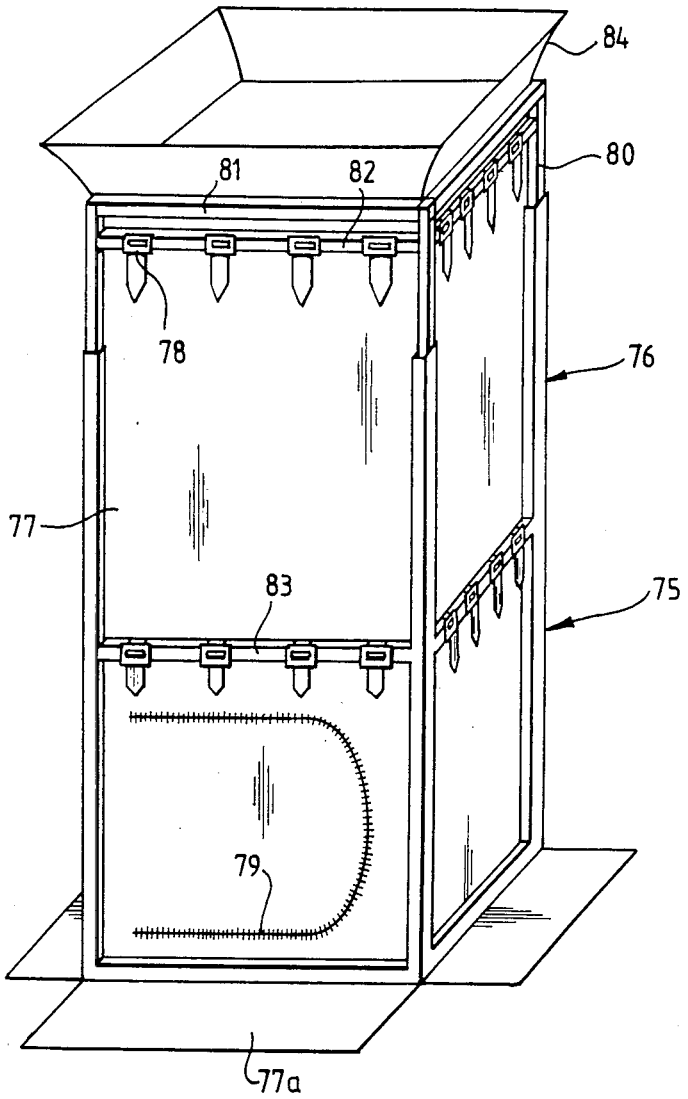
FIG. 13 is a perspective view of the external frame of a third embodiment of the present invention.

Referring to FIG. 13, an alternative arrangement is one in which the external frame comprises a lower fixed framework 75 and an upper expandable framework 76, a cover 77 being suspended within both frameworks by buckles and straps 78 so as to lie completely within the framework 75 and 76.

The cover has a zipped door 79 in one side, in the region of the lower framework 75 and has floor sealing flaps 77*a*.

The upper part of the framework 76 comprises telescopic members 80 which fit within each upright of the framework 76. Each telescopic member is held within its associated upright by means of a compression spring, so that the upper framework 76 can be shortened by pushing the telescopic members 80 down within the uprights of framework 76.

Between each of telescopic members 80 there extends two bars, an upper bar 81 and a lower bar 82, and between each pair of uprights of the lower framework 75 there extends a single bar 83. The cover is attached to the framework 75 and 76 at two levels at a lower level to bars 83 and at a higher level at bars 82, by means of buckles and straps 78. A flange 84 extends all around the top edges of the cover, for sealing the enclosure to a hazardous environment. This type of enclosure is particularly suited to for instance removing asbestos panels from a ceiling, in which case the flange 84 would be sealed around the panel or panels, an aperture would enter from the bottom of the enclosure via zipped door 79, climb a ladder extending through each of the lower and upper compartments to reach the ceiling panels to be removed. A particular advantage of this arrangement is that the enclosure may be easily slid across a floor to another ceiling panel to be removed, by shortening the upper framework 76.

I claim:

1. A multi-chamber enclosure for use in a hazardous environment and which comprises:

an external frame;

a flexible cover suspended from and arranged within the frame so as to form a roof, side and end walls of the enclosure;

a first closable opening formed in the cover at one end wall of the enclosure through which an operative may pass between the enclosure and a surrounding clean environment;

a second closable opening formed in the cover at an opposite end wall of the enclosure through which an operative may pass between the enclosure and an adjacent hazardous environment;

a sealing arrangement provided on said opposite end wall for sealingly communicating said second opening with the hazardous environment;

a vent in said one end wall to permit air to be drawn from the clean environment and through the enclosure to said opposite end wall;

a flexible partitioning wall arranged within the enclosure to define two separate chambers therein, said partitioning wall including side portions each secured to a respective side wall of the enclosure and defining therebetween an access opening between the chambers; and a freely suspended flexible door flap arranged to close said access opening and located on the downstream side of said partitioning wall, the door flap being movable in a direction away from the partitioning wall in order to uncover said access opening and to allow air to be drawn through the enclosure and being returnable to its closing position when air is no longer drawn through the enclosure.

2. A multi-chamber enclosure according to claim 1, in which the side portions of the partitioning wall comprise two separate side flaps defining a rectangular access opening therebetween, the flexible door flap being freely suspended from its upper end and laterally overlapping said side flaps to close said access opening.

3. A multi-chamber enclosure according to claim 1, in which the partitioning wall comprises a single piece of material having an oval access opening defined therein, and said flexible door flap is arranged to cover and overlap the edges defining said oval access opening.

4. A multi-chamber enclosure according to claim 1, in which a flexible zip-fastened door is provided in said one end wall of the enclosure.

5. A multi-chamber enclosure according to claim 1, in which said sealing arrangement comprises a flanged enclosure projecting laterally from said opposite end wall of the enclosure.

6. A multi-chamber enclosure according to claim 5, including a flexible partition arranged adjacent to said opening in said opposite end wall of the enclosure, said partition comprising a pair of laterally spaced flexible side flaps each secured to a respective side wall of the enclosure and defining a space therebetween, and a flexible door flap arranged on the downstream side of said side flaps and laterally overlapping the side flaps so as to close said space, said door flap being movable away from the side flaps to uncover said space.

7. A multi-chamber enclosure according to claim 1, including a sealed-in floor of flexible material which is continuous with the side and end walls of the enclosure and which lies completely within said frame.

8. A multi-chamber enclosure according to claim 1, in which the cover is made of flame retardant plastics sheeting which is fibre reinforced for extra strength.

9. A multi-chamber enclosure according to claim 8, including a plurality of sealing flaps at the lower end of the cover and extending beyond the confines of the enclosure to pass underneath base members of the frame to form a seal with the floor.

10. A multi-chamber enclosure for use in a hazardous environment and which comprises:

an external frame;

a flexible cover suspended from and arranged within the frame so as to form a roof, side and end walls of the enclosure;

a first closable opening formed in the cover at one end wall of the enclosure through which an operative may pass between the enclosure and an adjacent clean environment;

a second closable opening formed in the cover at another end wall of the enclosure through which an operative may pass between the enclosure and an adjacent hazardous environment;

a sealing arrangement provided on said other end wall for sealingly communicating said second opening with the hazardous environment;

an opening in said flexible cover in the region of said other end wall for communicating with a source of air suction at the exterior of said enclosure;

a vent in the region of said one end wall to permit air to be drawn from the clean environment and through the enclosure to said opening in the region of said other end wall;

a flexible partitioning wall arranged within the enclosure to define two separate chambers therein, said partitioning wall including side portions each secured to a respective side wall of the enclosure and defining therebetween an access opening between the chamber; and a suspended flexible door flap arranged to close said access opening and located on the downstream side of said partitioning wall, said door flap being movable in the direction away from the partitioning wall in order to uncover said access opening and to allow air to be drawn through the enclosure and adapted to return to its closing position for sealing the chambers with respect to each other in response to the cessation of air being drawn through the enclosure.

* * * * *